US006095329A

United States Patent [19]

Kao

[11] Patent Number: 6,095,329

[45] Date of Patent: Aug. 1, 2000

[54] SOCKET STUD FOR TOOL SUSPENSION RACK

[76] Inventor: Jui-Chien Kao, No. 358, Tunghsing Rd., Shuwang Li, Tali City, Taichung Hsien, Taiwan

[21] Appl. No.: 09/376,366

[22] Filed: Aug. 18, 1999

[51] Int. Cl.[7] ..... B65D 85/20; A47F 7/00

[52] U.S. Cl. ..... 206/378; 206/806; 211/70.6

[58] Field of Search ..... 206/372, 376, 206/377, 378, 806, 493; 211/70.6, 69

[56] References Cited

U.S. PATENT DOCUMENTS

| | | | |
|---|---|---|---|
| 5,573,116 | 11/1996 | Zink | 206/378 |
| 5,715,951 | 2/1998 | Dembicks | 211/70.6 |
| 5,725,107 | 3/1998 | Dembicks | 211/70.6 |
| 5,855,284 | 1/1999 | Dembicks | 211/70.6 |
| 5,862,913 | 1/1999 | Chou | 206/378 |
| 5,897,001 | 4/1999 | Dembicks | 211/70.6 |
| 5,967,340 | 10/1999 | Kao | 211/70.6 |
| 5,975,297 | 11/1999 | Kao | 206/378 |
| 5,992,626 | 11/1999 | Anderson | 206/378 |

*Primary Examiner*—Bryon P. Gehman
*Attorney, Agent, or Firm*—Bacon & Thomas, PLLC

[57] ABSTRACT

A socket stud for a tool suspension rack comprising a suspension rack having two edges and a raised central portion with two ends. At least one socket rack is mounted on the suspension rack. The socket rack has a T-shaped locking recess with two lugs and at least one socket stud extending therefrom. The socket rack includes a top portion abutting the raised central portion of the suspension rack and a bottom portion with two ends each abutting the edges of the suspension rack. Two lugs of the T-shaped locking recess respectively abut the two ends of the raised portion of the suspension rack. The socket rack includes a passage having a flexible strip parallel to the T-shaped locking recess with a retaining boss. At least one C-shaped clamp or at least one T-shaped flange extends from the socket rack.

6 Claims, 8 Drawing Sheets

SOCKET STUD FOR TOOL SUSPENSION RACK

CROSS-REFERENCES TO RELATED APPLICATIONS

Not Applicable.

BACKGROUND OF THE INVENTION

1. Field of the Invention

The present invention relates to a socket stud for tool suspension rack, and more particularly to a socket stud that slides onto a tool suspension rack.

2. Description of the Related Art

The closest prior art of which the applicant is aware is disclosed in U.S. patent application Ser. No. 09/258,607, entitled "Socket Stud For Tool Suspension Rack".

A first conventional socket suspension rack (60) in accordance with the prior art as shown in FIG. 7 comprises a square socket stud (62) containing a cavity (63), a ball (65) received in the cavity (63) partially exposed outward from the socket stud (62), a spring (64) received in the cavity (63) and pressing on the ball (65), and a holder (61) formed on the top of the socket stud (62). A socket (not shown) can be mounted on the socket stud (62), with the ball (65) detachably received in the depression (not shown) contained in the socket. The holder (61) is secured on an elongated track (not shown), thereby attaching the socket suspension rack (60) together with the socket to the elongated track. However, the spring (64) and the ball (65) must be pressed into the recess (63) after the socket stud (62) is formed by injection molding such that the assembly process of the socket suspension rack (60) is complicated, thereby increasing the cost of making it.

A second conventional socket suspension rack (70) in accordance with the prior art shown in FIG. 8 includes a square socket stud (71) attached to a suspension plate (72) and received in the recess (81) of a socket (80). The socket stud (71) contains an opening (73) defined in the bottom thereof, and includes a retaining stud (74) detachably received in a cavity (82) in the recess (81), thereby attaching the socket (80) to the socket stud (71) of the socket suspension rack (70). However, the opening (73) in the bottom of the socket stud (71) requires the use of two opposed molds (not shown) to make the socket stud (71), and an auxiliary mold (not shown) is additionally needed to form the opening (73), thereby increasing the cost of making the socket stud (71). In addition, the retaining stud (74) has little elasticity, thereby making it inconvenient to detach the retaining stud (74) from the cavity (82).

Referring to FIG. 9, in accordance with a third embodiment of the prior art, the square body (94) of the socket stud is attached to a socket rack (91) which includes a flat plate (92) having two distal ends formed with a C-shaped clamp (93) and a mediate portion formed with a hook (921) containing an inverted T-shaped locking recess (922). The socket (80) as shown in FIG. 8 is fit on the square body (94) of the socket rack (91) that is attached to a tool suspension rack (not shown) by attaching the hook (921) to a guide track (not shown) of the tool suspension rack (not shown), thereby hanging the socket (80) on the tool suspension rack (not shown). The C-shaped clamp (93) can be used to hold a tool such as a drive head (not shown) therein. However, the T-shaped locking recess (922) does not hold the suspension rack (not shown) very securely because it is an opened design. Therefore, the socket rack (91) is able to slide easily on the suspension rack (not shown).

The present invention has arisen to mitigate and/or obviate the disadvantage of the conventional socket stud for tool suspension rack.

BRIEF SUMMARY OF THE INVENTION

In accordance with one aspect of the present invention, a socket stud that slides onto a tool suspension rack comprises a suspension rack having two edges and a raised central portion with two ends. At least one socket rack is mounted on the suspension rack. The socket rack has a T-shaped locking recess with two lugs and at least one socket stud extending from the socket rack. The socket rack includes a top portion abutting the raised portion and a bottom portion with two ends each abutting the extremity of the suspension rack.

Further benefits and advantages of the present invention will become apparent after a careful reading of the detailed description with appropriate reference to the accompanying drawings.

DETAILED DESCRIPTION OF THE INVENTION

Figure 1:
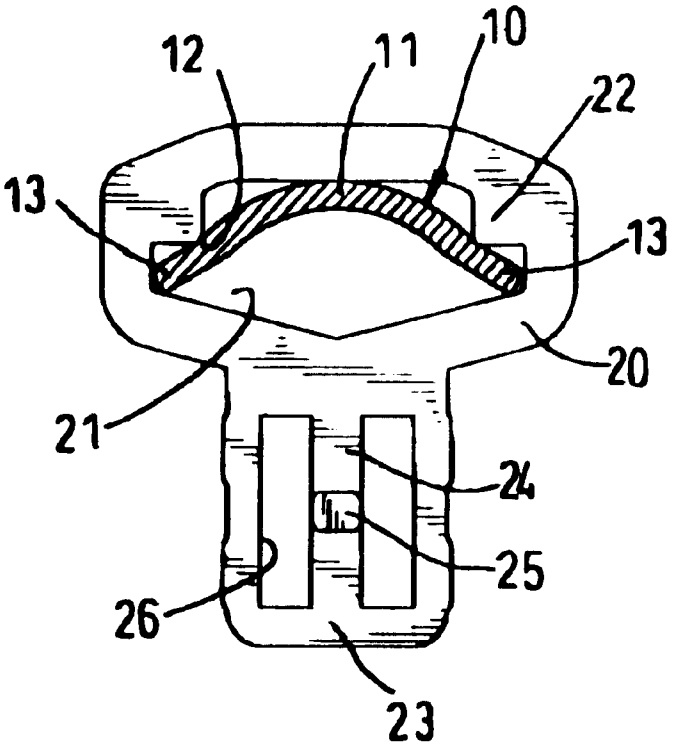
FIG. 1 is a front plan view of a socket rack in accordance with the present invention mounted on the suspension rack.
Figure 6:
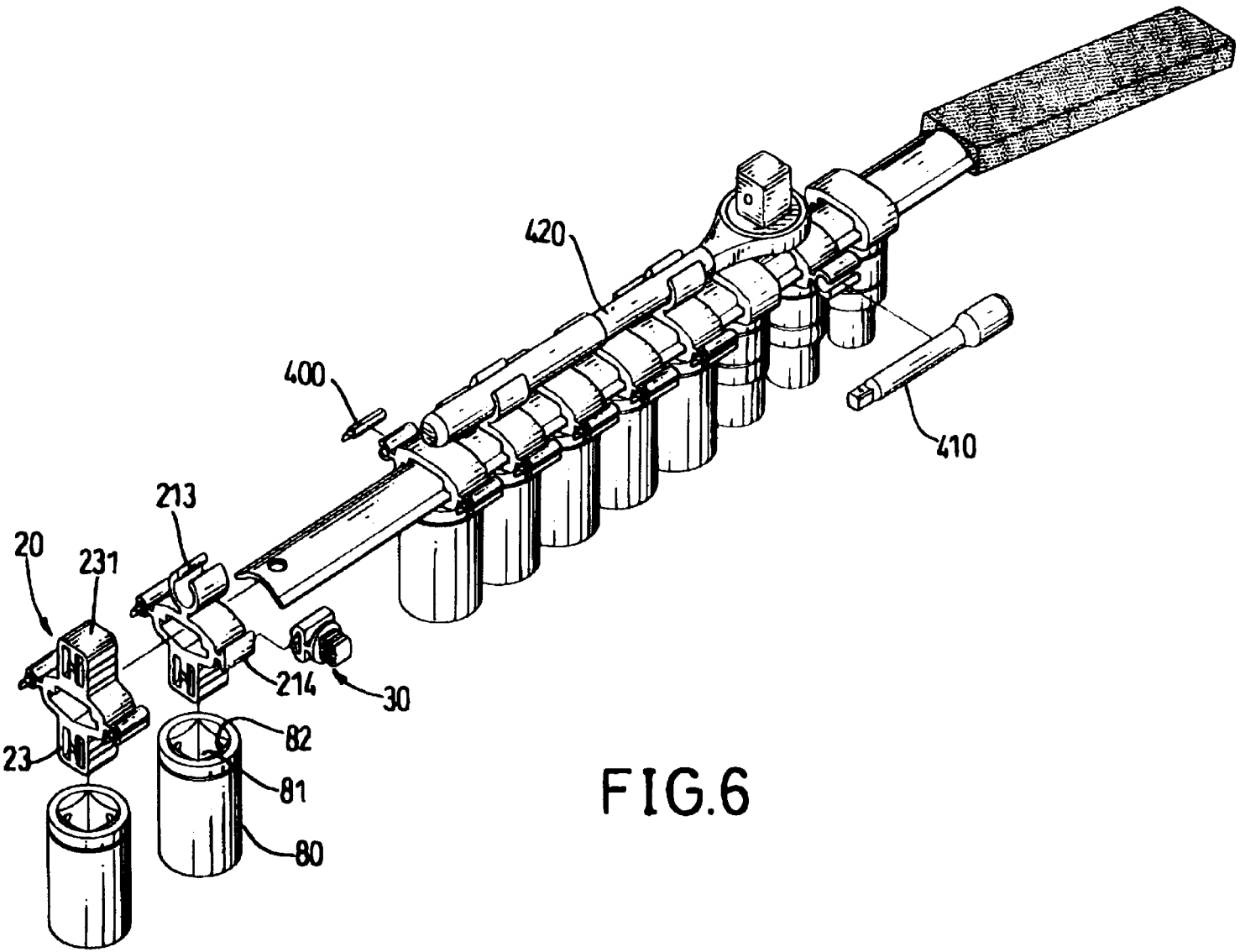
FIG. 6 is a exploded perspective view of the socket studs in FIGS. 2 and 4 mounted on the suspension rack.
Figure 7:
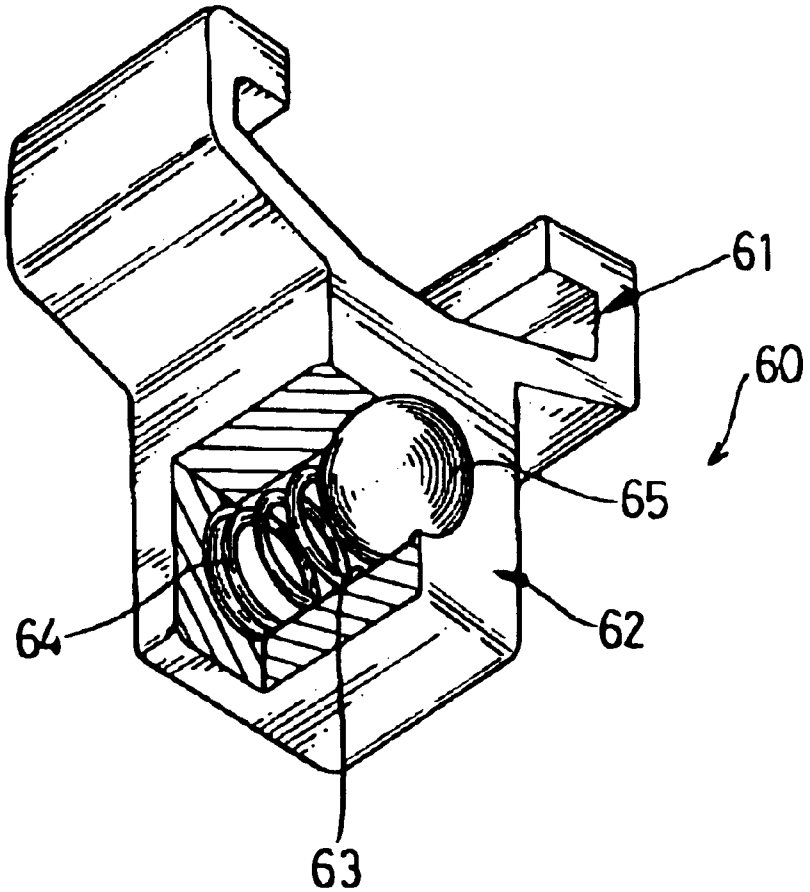
FIG.7 PRIOR ART
FIG. 7 is a perspective view of a conventional socket stud in accordance with the prior art.
Figure 8:
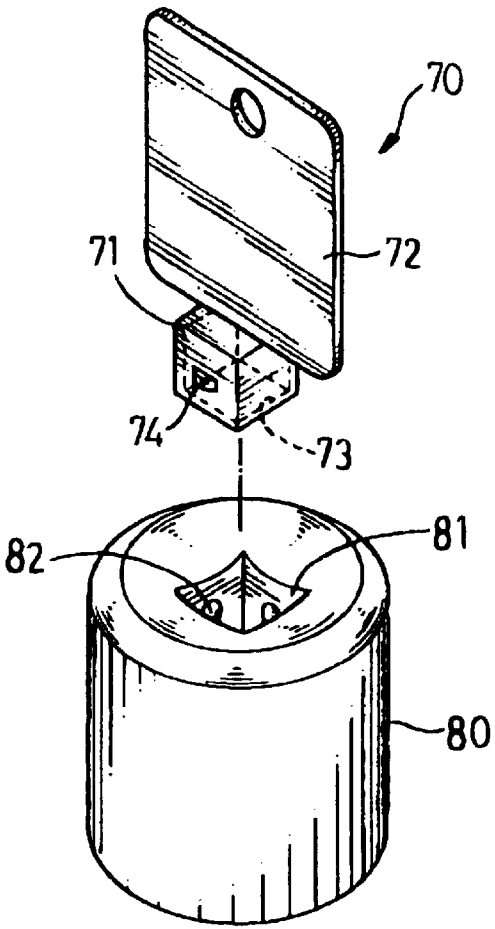
FIG.8 PRIOR ART
FIG. 8 is a perspective view of another conventional socket stud.
Figure 9:
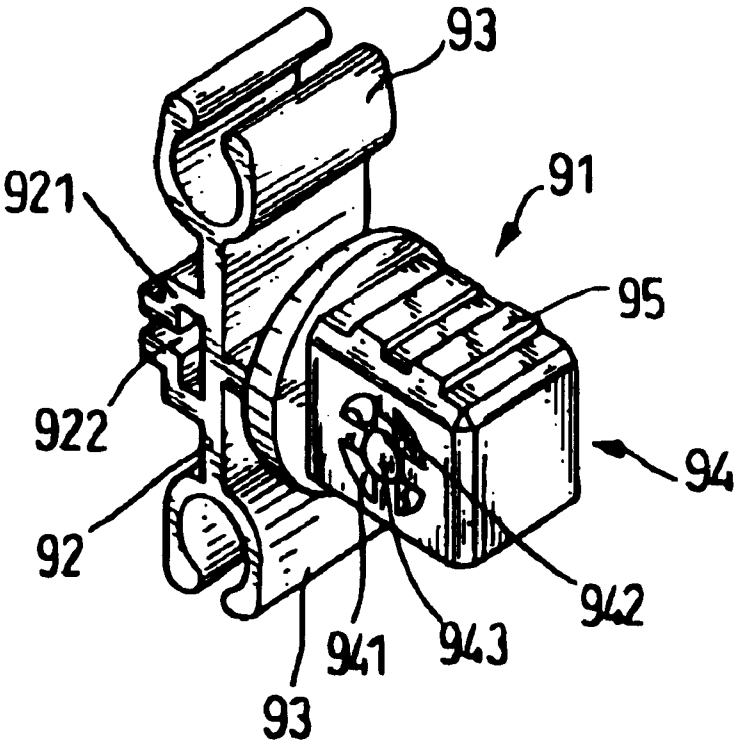
FIG.9 PRIOR ART
FIG. 9 is a perspective view of another conventional socket stud.

Referring to the drawings and initially to FIGS. 1, a socket stud configured to slide onto a tool suspension rack in accordance with the present invention comprises a suspension rack (10) having two edges (13) and a raised central portion (11) with two ends (12). At least one socket rack (20) is mounted on the suspension rack (10) with each socket rack (20) having a T-shaped locking recess (21) with two lugs (22) and at least one socket stud (23) extending from the socket rack (20). The socket rack (20) includes a top portion abutting the raised central portion (11) of the suspension rack (10) and a bottom portion with two ends each abutting the edges (13) of the suspension rack (10). The two lugs (22) of the T-shaped locking recess (21 ) abut the ends (12) of the raised portion (11). The socket rack (20) includes a passage (26) parallel to the T-shaped locking recess (21), and a flexible strip (24) having a retaining boss (25). Referring to FIG. 6, at least one C-shaped clamp or at least one T-shaped flange (214) extends from the socket rack (20) to form the various embodiments of the socket rack (20).

Referring to FIG. 1, a first embodiment of the socket rack (20) has a socket stud (23) extending from the socket rack (20). A socket can be mounted on the socket stud (23).

Figure 2:
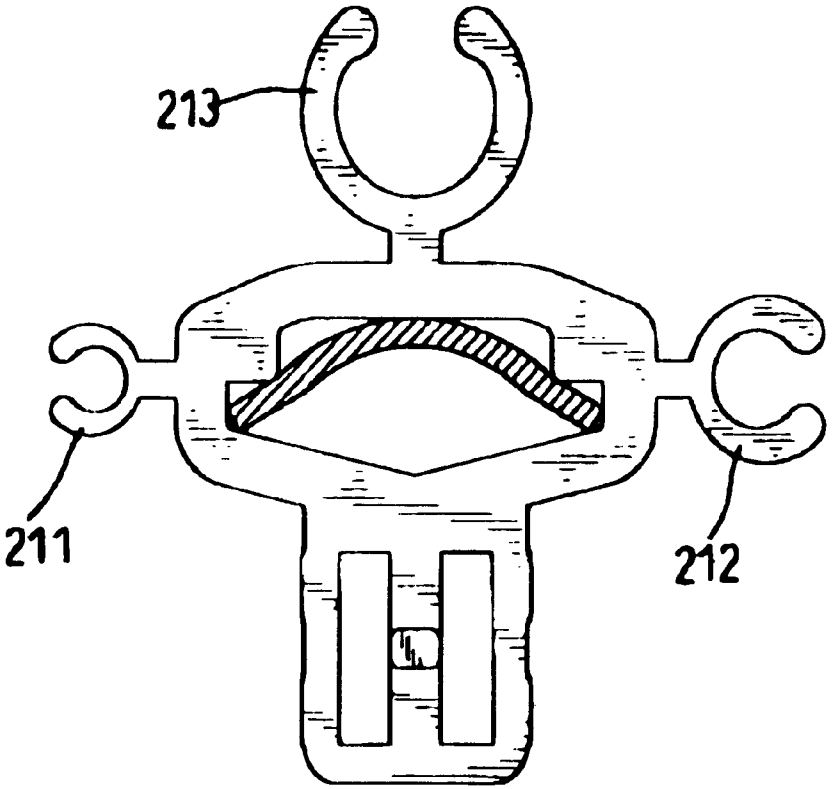
FIG. 2 is a front plan view of another embodiment of the socket rack shown in FIG. 1.

Referring to FIG. 2, a second embodiment of the socket rack (20) has a socket stud (23), a first C-shaped clamp (211), a second C-shaped clamp (212) and a third C-shaped clamp (213) extending from the socket rack (20). As shown in FIG. 6, a socket (80) can be mounted on the socket stud (23). The first C-shaped clamp (211) can be used to hold a tool such as a screwdriver head (400), the second C-shaped clamp (212), a socket extension bar (410), and the third C-shaped clamp (213), a socket handle (420).

Figure 3:
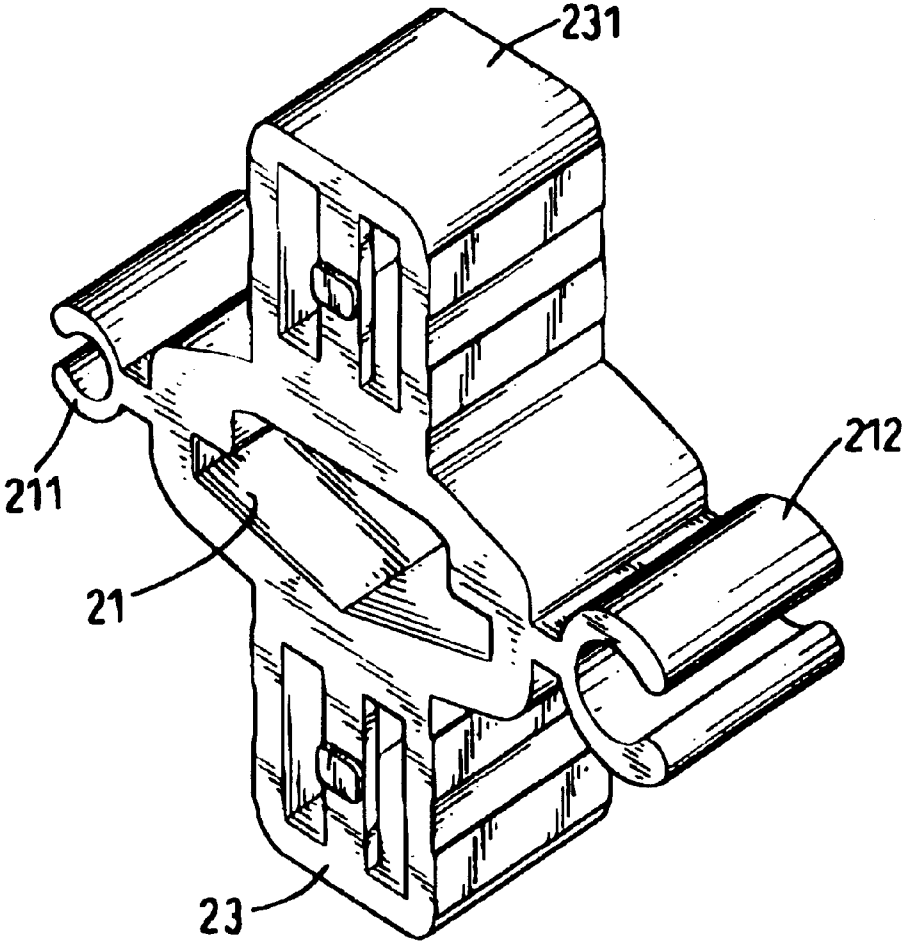
FIG. 3 is perspective view of another embodiment of the socket rack shown in FIG. 1.

Referring to FIG. 3, a third embodiment of the socket rack (20) has a socket stud (23), a second socket stud (231), a first C-shaped clamp (211) and a second C-shaped clamp (212) extending from the socket rack (20). The socket rack (20) can be used to hold two sockets (80) and two tools at the same time.

Figure 4:
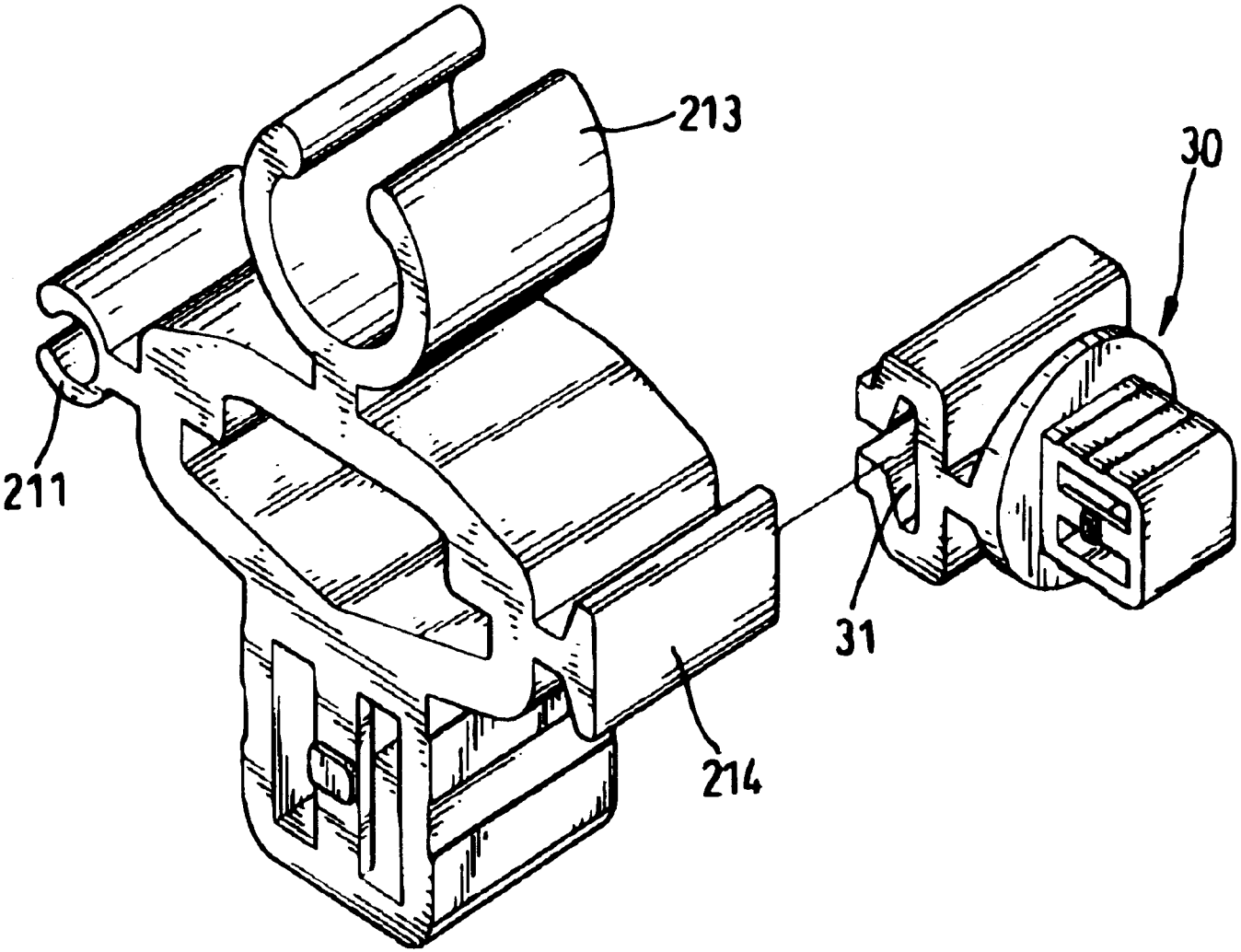
FIG. 4 is an exploded perspective view of another embodiment of the socket stud shown in FIG. 1.

Referring to FIG. 4, a fourth embodiment of the socket rack (20) has a socket stud (23), a first C-shaped clamp (211), a third C-shaped clamp (213) and a flange (214) parallel to the locking recess (21) extending from the socket rack (20). The flange (214) can be used to connect a second socket rack (30) to the flange (214) by sliding the groove (31) in the second socket rack (20) onto the flange (214).

Figure 5:
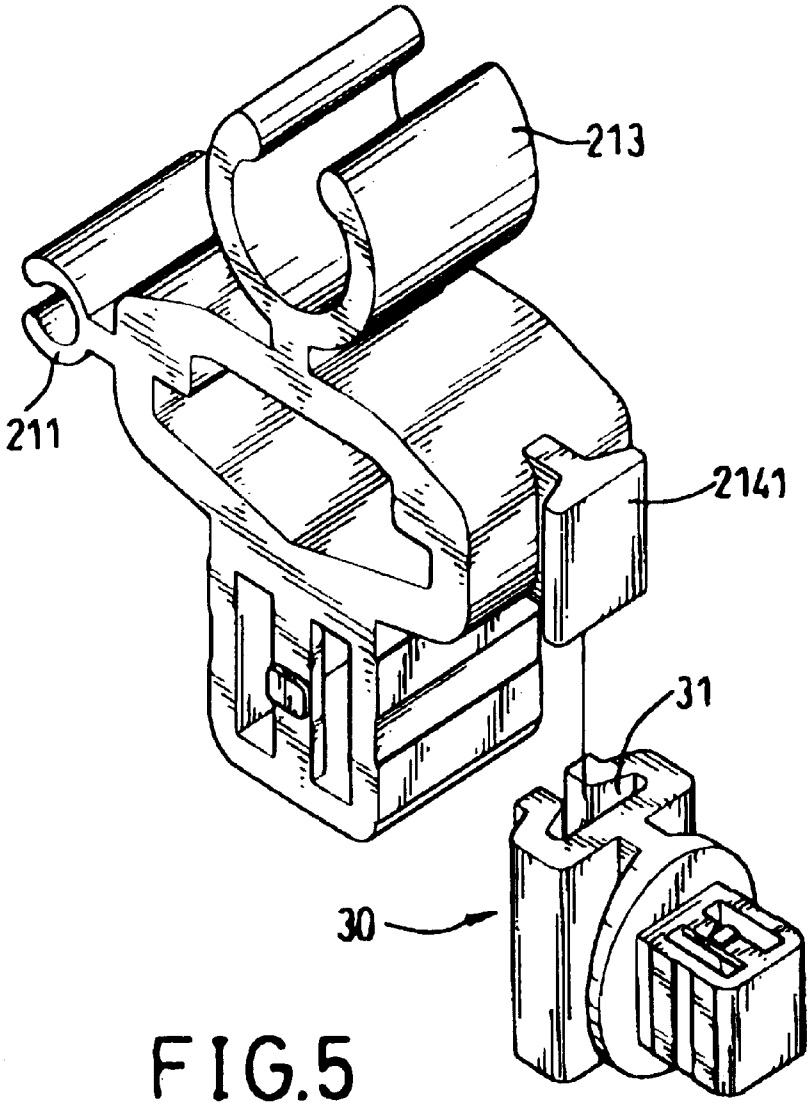
FIG. 5 is a perspective view of another embodiment of the socket stud in FIG. 1.

Referring to FIG. 5, a fifth embodiment of the socket rack (20) has a socket stud (23), a first C-shaped clamp (211), a third C-shaped clamp (213) and a flange (2141) perpendicular to the locking recess (21) extending from the socket rack (20).

Referring to FIG. 6, in use, various embodiments of the socket rack (20) can be used simultaneously with the tool suspension rack to meet the users specific needs, thereby greatly increasing the flexibility and utility.

Although the invention has been explained in relation to its preferred embodiments, it is to be understood that many other possible modifications and variations can be made without departing from the spirit and scope of the invention as hereinafter claimed.

What is claimed is:

1. A socket stud and a tool suspension rack comprising:

a suspension rack (10) having two edges (13) and a raised central portion (11), at least one socket rack (20) mounted on said suspension rack (10) and having a T-shaped locking recess (21) with two lugs (22), at least one socket stud (23) extending from said at least one socket rack (20), and said at least one socket rack (20) including a passage (26) disposed parallel to said T-shaped locking recess (21).

2. The socket stud and tool suspension rack in accordance with claim 1, wherein said T-shaped locking recess (21) of said at least one socket rack (20) includes a top portion abutting said raised central portion (11) of said suspension rack (10) and a bottom portion with two ends, each end abutting an edge (13) of said suspension rack (10).

3. The socket stud and tool suspension rack in accordance with claim 1, wherein said two lugs (22) of said T-shaped locking recess (21) respectively abut two ends (12) of said raised portion (11) of the suspension rack (10).

4. The socket stud and tool suspension rack in accordance with claim 1, wherein said passage (26) includes a flexible strip (24) formed therein and provided with a retaining boss (25) thereon.

5. The socket stud and tool suspension rack in accordance with claim 1, wherein at least one C-shaped clamp (211, 212, 213) extends from said at least one socket rack (20).

6. The socket stud and tool suspension rack in accordance with claim 1, wherein at least one T-shaped flange (214, 2141) extends from said at least one socket rack (20).

* * * * *